US008091231B2

(12) United States Patent
Arito

(10) Patent No.: US 8,091,231 B2
(45) Date of Patent: Jan. 10, 2012

(54) SPINNING METHOD OF A WORK PIECE IN A NON-CIRCULAR CYLINDRICAL SHAPE AND APPARATUS FOR THE SAME

(75) Inventor: Hiroshi Arito, Amagasaki (JP)

(73) Assignee: Nihon Spindle Mfg Co., Ltd., Hyogo (JP)

( * ) Notice: Subject to any disclaimer, the term of this patent is extended or adjusted under 35 U.S.C. 154(b) by 482 days.

(21) Appl. No.: 12/345,978

(22) Filed: Dec. 30, 2008

(65) Prior Publication Data

US 2009/0193870 A1 Aug. 6, 2009

(30) Foreign Application Priority Data

Feb. 6, 2008 (JP) ..... 2008-26449

(51) Int. Cl.
*B21D 51/16* (2006.01)
*B21D 39/00* (2006.01)

(52) U.S. Cl. ..... 29/890; 29/896.62; 29/508; 29/516; 72/83; 72/121

(58) Field of Classification Search ..... 72/83, 84, 72/121; 29/890, 896.62, 580, 515, 508
See application file for complete search history.

(56) References Cited

U.S. PATENT DOCUMENTS 6,381,843 B1 * 5/2002 Irie et al. ..... 72/84
6,701,617 B2 * 3/2004 Li et al. ..... 29/890
6,769,281 B2 * 8/2004 Irie et al. ..... 72/121
7,152,445 B2 * 12/2006 Massee ..... 72/84
7,174,634 B2 * 2/2007 Morikawa et al. ..... 29/890
2002/0062562 A1 * 5/2002 Li et al. ..... 29/890
2002/0095787 A1 * 7/2002 Irie et al. ..... 29/890
2005/0257588 A1 * 11/2005 Lancaster ..... 72/84

FOREIGN PATENT DOCUMENTS

EP 1 053 799 11/2000

OTHER PUBLICATIONS

European Search Report issued Jul. 6, 2009 in European Application No. 08171690.4.

* cited by examiner

*Primary Examiner* — David Jones
(74) *Attorney, Agent, or Firm* — Wenderoth, Lind & Ponack, L.L.P.

(57) ABSTRACT

The present invention provides a spinning method of a work piece in a non-circular cylindrical shape capable of eliminating a swollen part, without causing any creases or depressions on the formed face, by performing spinning to the swollen part produced in a region near the minor axis of the work piece in a non-circular cylindrical shape. A spinning method for spinning the end part of the work piece into a circular cylindrical shape comprises a spindle mechanism provided with a spinning roller at the tip of the spindle and a work piece holding mechanism for holding the work piece in a non-circular cylindrical shape disposed face to face with the spindle mechanism, and includes performing spinning for forming the end part of the work piece into an inclined face inclined so as to gradually reduce in diameter, and then performing spinning on the swollen part in a region near the minor axis of the work piece by displacing the work piece by a prescribed angle in the plane containing the minor axis plane of the work piece in a non-circular cylindrical shape.

3 Claims, 7 Drawing Sheets

SPINNING METHOD OF A WORK PIECE IN A NON-CIRCULAR CYLINDRICAL SHAPE AND APPARATUS FOR THE SAME

BACKGROUND OF THE INVENTION

I. Title of the Invention

The present invention concerns a spinning method for performing spinning to the end part of a work piece in a non-circular cylindrical shape or, more preferably, a work piece in an elliptical shape including an ellipse and a flat part, and an apparatus for implementing such a method.

II. Description of Related Art

FIG. 7 through FIG. 9 illustrate an example in which spinning was performed by a conventional method on a work piece W in a non-circular cylindrical shape, a work piece in an elliptical shape for example, to manufacture a muffler 50 for an automobile.

This working method consists of forming an end part of the work piece W in an elliptical shape into an inclined face 52 inclined in a way so as to have a gradual reduction in diameter, and performing spinning, for forming a certain length of the end part into a circular cylindrical shape 51 with a prescribed diameter, to both end parts of the work piece W, to make the work piece W into a product 50 (muffler for automobile).

When this conventional working method is employed, a swollen part b is produced, as shown in FIG. 9, in a region near the minor axis a of the work piece W, because the roller does not come into contact with that region at the time of spinning and the pads of the work piece W in the surrounding area gather in that region. A problem was that this swollen part b not only spoils the appearance of the product 50 (muffler for automobile) but also has negative influences on the product performance.

To cope with this problem, the present applicant proposed, previously, a spinning method of a work piece in a non-circular cylindrical shape realized in a way to eliminate the swollen part b for solving this problem, by performing spinning to the swollen part b produced in a region near the minor axis a of the work piece W (see Japanese Laid-open Patent Application No. 2001-257256).

This working method consists in forming, as shown in FIG. 10 to 11, an end part of the work piece W in an elliptical shape into an inclined face 33 inclined in a way so as to have a gradual reduction in diameter, and moving the work piece W, which has been submitted to spinning for forming a certain length of the end part of the work piece into a circular cylindrical shape 32 with a prescribed diameter, in the radial direction of a minor axis (upward in FIG. 10 to 11) of the work piece W, setting the working locus A' of the spinning roller R at a radius close to the curved surface of the minor axis 31 of the work piece W, and forming a formed face 34 by performing spinning in the state in which, at least, the unworked part (part with which the roller did not come into contact at the time of spinning in the preceding process) of the minor axis 31 is positioned on the spinning roller R side with reference to the working locus A' of the spinning roller R, to make the work piece into a product 30 (muffler for automobile) without the swollen part b.

SUMMARY OF THE INVENTION

The above-described working method proposed by the present applicant has an advantage of enabling the ability to obtain a muffler for automobile 30 without swollen part b, while on the other hand the method had the problem of causing creases or depressions on the formed face 34 because the spinning roller R come into contact with the swollen part b, positioned on the spinning roller R side with reference to the working locus A' of the spinning roller R, right from the side face and temporarily apply a heavy load to the swollen part b, making smooth spinning difficult.

The objective of the present invention, realized in view of such problems of the above-described conventional spinning methods of a work piece in a non-circular cylindrical shape, is to provide a spinning method of work piece in a non-circular cylindrical shape capable of eliminating the swollen part, without causing any creases or depressions on the formed face, by performing spinning on the swollen part produced in a region near the minor axis of the work piece in a non-circular cylindrical shape, and an apparatus for performing the method.

To achieve this objective, the spinning method of a work piece in non-circular cylindrical shape according to the present invention is a spinning method comprising a spindle mechanism provided with a spinning roller at the tip of the spindle and a work piece holding mechanism for holding the work piece in a non-circular cylindrical shape disposed face to face with the spindle mechanism, for spinning the end part of the work piece into a circular cylindrical shape, characterized in that it consists in performing spinning for forming the end part of the work piece into an inclined face inclined so as to gradually reduce the diameter of the work piece, and then performing spinning on the swollen part produced in a region near the minor axis of the work piece by displacing the work piece by a prescribed angle in the plane containing the minor axis plane of the work piece in a non-circular cylindrical shape.

In this case, it may be possible to move the work piece, displaced by a prescribed angle in the plane containing the minor axis plane of the work piece in a non-circular cylindrical shape, in the plane, while performing spinning on the swollen part produced in a region near the minor axis of the work piece in a non-circular cylindrical shape.

Moreover, the spinning apparatus according to the present invention for implementing the spinning method of a work piece in a non-circular cylindrical shape is a spinning apparatus comprising a spindle mechanism provided with a spinning roller at the tip of the spindle and a work piece holding mechanism for holding the work piece in non-circular cylindrical shape disposed face to face with the spindle mechanism, for spinning the end part of the work piece into a circular cylindrical shape, characterized in that it further comprises a displacing mechanism for displacing the work piece by a prescribed angle in the plane containing the minor axis plane of the work piece in a non-circular cylindrical shape, which has been submitted to spinning for forming the end part into an inclined face inclined so as to gradually reduce the diameter, to perform spinning on the swollen part in a region near the minor axis of the work piece in a non-circular cylindrical shape by displacing the work piece by a prescribed angle in the plane containing the minor axis plane of the work piece in a non-circular cylindrical shape by means of the displacing mechanism.

In this case, it may be possible to provide a moving mechanism for moving the work piece, displaced by a prescribed angle in the plane containing the minor axis plane of the work piece in a non-circular cylindrical shape, in the plane, while performing spinning to the swollen part in a region near the minor axis of the work piece.

According to the spinning method of a work piece in a non-circular cylindrical shape and the apparatus for performing the method of the present invention, by performing spinning for forming an end part of the work piece into an inclined face inclined so as to gradually reduce the diameter, and then performing spinning to the swollen part in a region near the minor axis of the work piece by displacing the work piece by a prescribed angle in the plane containing the minor axis plane of the work piece in a non-circular cylindrical shape, it becomes possible to eliminate the swollen part, without causing any creases or depressions on the formed face, because the working locus of the spinning roller becomes a smooth curve along the ridgeline of the swollen part, without temporarily applying any heavy load to the swollen part, thereby enabling performance of spinning smoothly.

Furthermore, it is also possible to set the shape of the formed face freely, by arranging the work piece, displaced by a prescribed angle in the plane containing the minor axis plane of the work piece in a non-circular cylindrical shape, in the plane, while performing spinning on the swollen part in a region near the minor axis of the work piece.

DETAILED DESCRIPTION OF THE INVENTION

Figure 1:
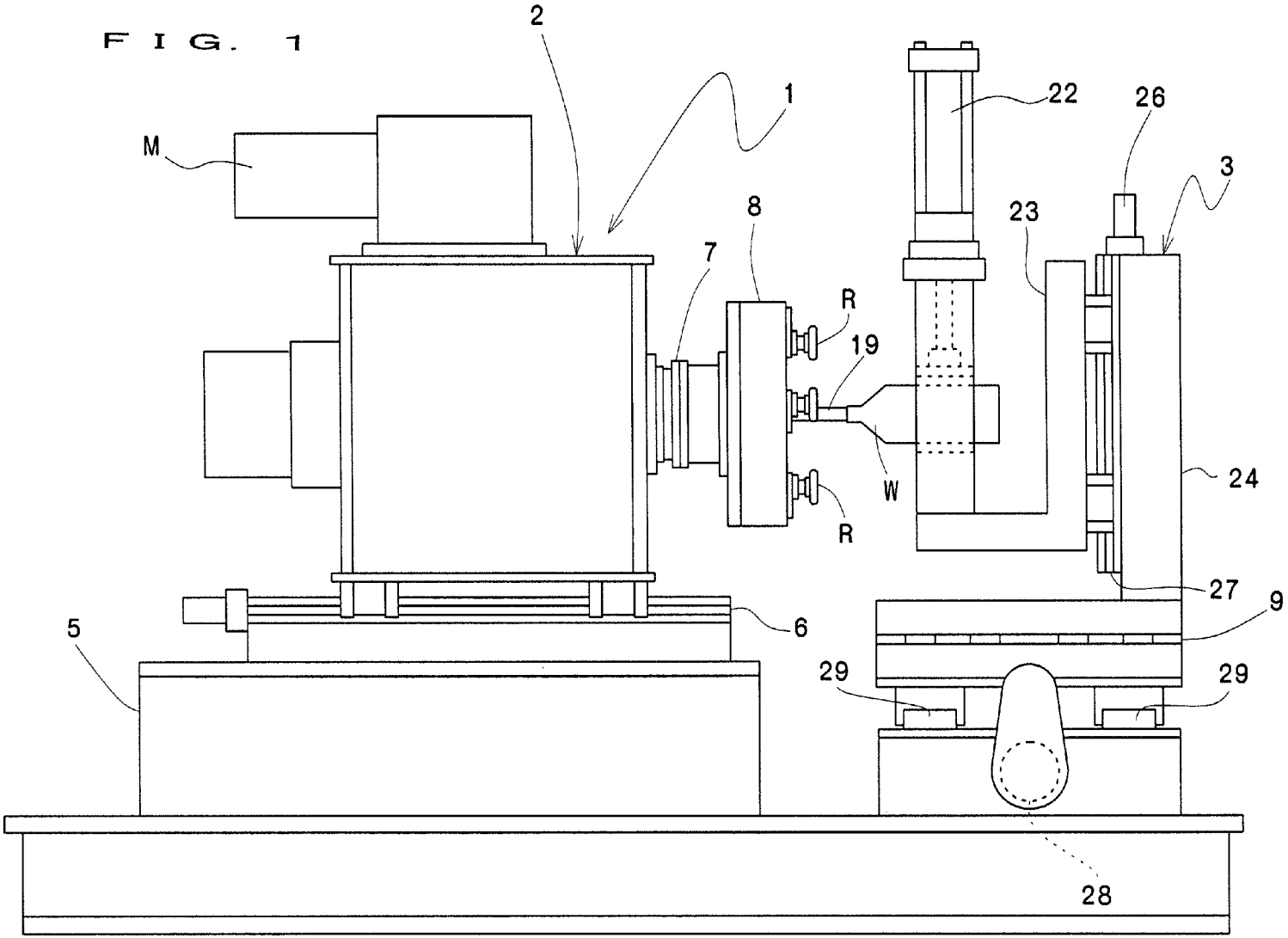
FIG. 1 is a front elevation showing an embodiment of the spinning apparatus of work piece in non-circular cylindrical shape according to the present invention.

An embodiment of the spinning method of a work piece in a non-circular cylindrical shape and the apparatus for performing the method according to the present invention will be described below with reference to drawings.

FIG. 1 to FIG. 6 show an embodiment of the spinning method of a work piece in a non-circular cylindrical shape and the apparatus for performing the method according to the present invention.

This spinning apparatus 1 of a work piece in non-circular cylindrical shape is constructed by comprising, as shown in FIG. 1 to FIG. 4, a spindle mechanism 2 provided with a spinning roller R at the tip of the spindle 7, and a work piece holding mechanism 3 for holding the work piece W in a non-circular cylindrical shape.

And, the spindle mechanism 2 is constructed in a way to be movable by a driving mechanism (not illustrated), on a travelling rail 6 installed on a base 5, so that the spindle mechanism 2 may be either in contact with or away from the work piece holding mechanism 3.

It is also possible to provide a similar moving mechanism on the work piece holding mechanism 3, to enable the spindle mechanism 2 and the work piece holding mechanism 3 to come into contact with or separate from each other.

At the tip of the spindle 7 of the spindle mechanism 2 is attached, through a mounting flange 8, a tool mount 10 supporting the spinning roller R as tool.

This tool mount 10 is constructed by comprising, as main component parts, a tool supporting member 11, directly supporting the spinning roller R as tool, a main mount 13 provided with a guide groove 12 for guiding this tool supporting member 11 in the radial direction, and a cam plate 14 provided with a spiral groove 15 for moving the spinning roller R in the radial direction.

The main mount 13 is installed by fixing to the mounting flange 8.

To the tool supporting member 11 is attached a guide pin 16, and this guide pin 16 is designed to be inserted in the spiral groove 15.

The spindle 7 has a hollow structure, so that a cam shaft 17 provided with a cam plate 14 at its tip may be inserted in the spindle 7, to connect the spindle 7 and the cam shaft 17 to each other through an appropriate speed-change mechanism V. Reference mark C indicates the operating mechanism of this speed-change mechanism, and reference mark M represents a driving motor.

With this construction, when the change gear ratio of the speed-change mechanism V is set for the same level, the main mount 13 and the cam plate 14 turn at the same speed. At that time, the tool supporting member 11 does not move in the radial direction.

On the other hand, the tool supporting member 11 moves in the radial direction in the case where the speed of the cam plate 14 is set lower or higher compared with the main mount 13 by means of the speed-change mechanism V.

Moreover, reference numeral 19 indicates a mandrel inserted in the work piece W in a non-circular cylindrical shape, and reference numeral 18 represents a connecting rod for making the mandrel 19 move forward and backward, connected to an appropriate cylinder (not illustrated).

Figure 2:
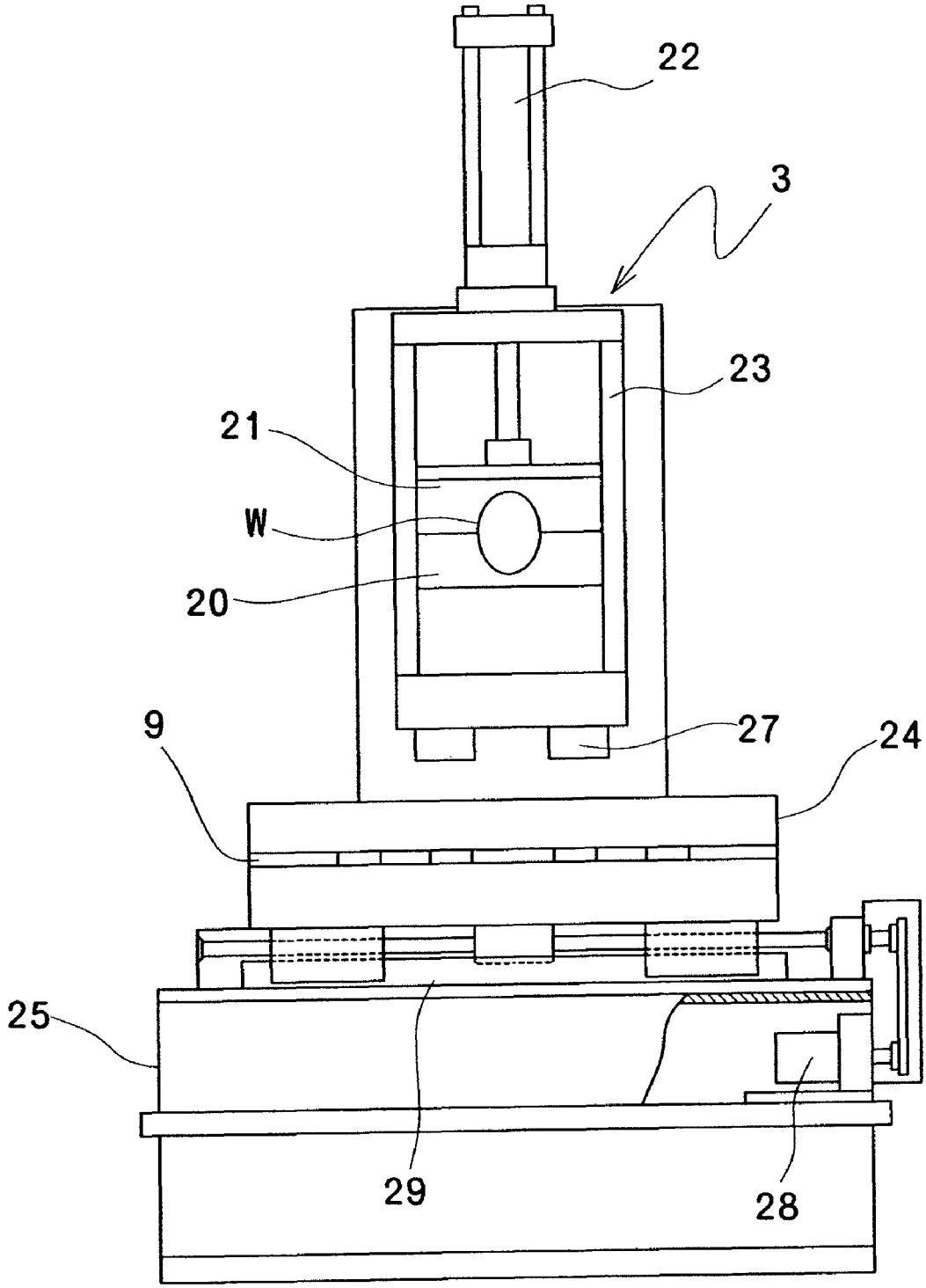
FIG. 2 is a side view of the work piece holding mechanism of the spinning apparatus above.
Figure 3:
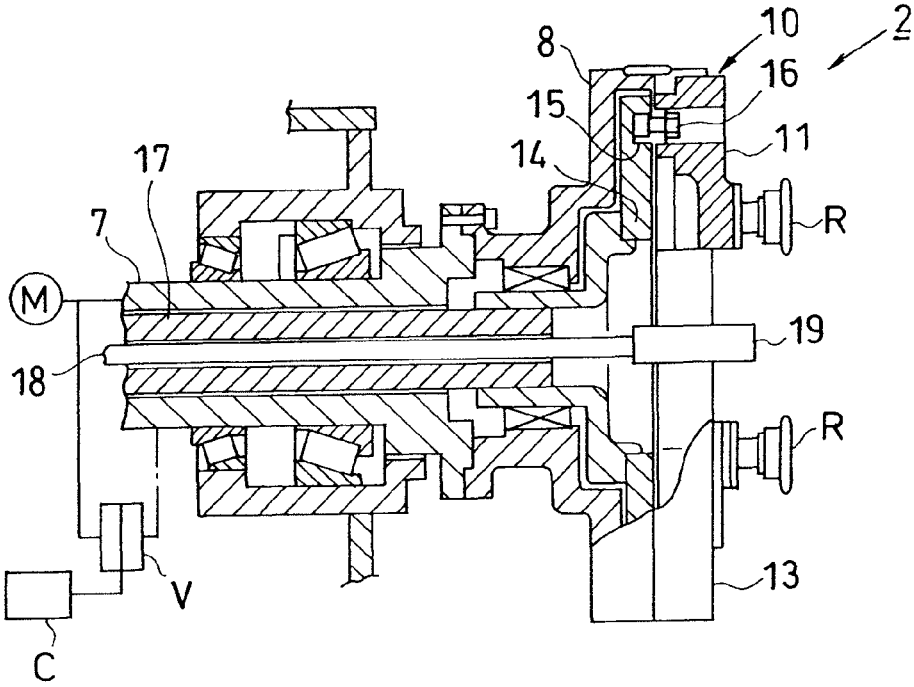
FIG. 3 is a longitudinal sectional view of the work piece holding mechanism of the spinning apparatus above.
Figure 4:
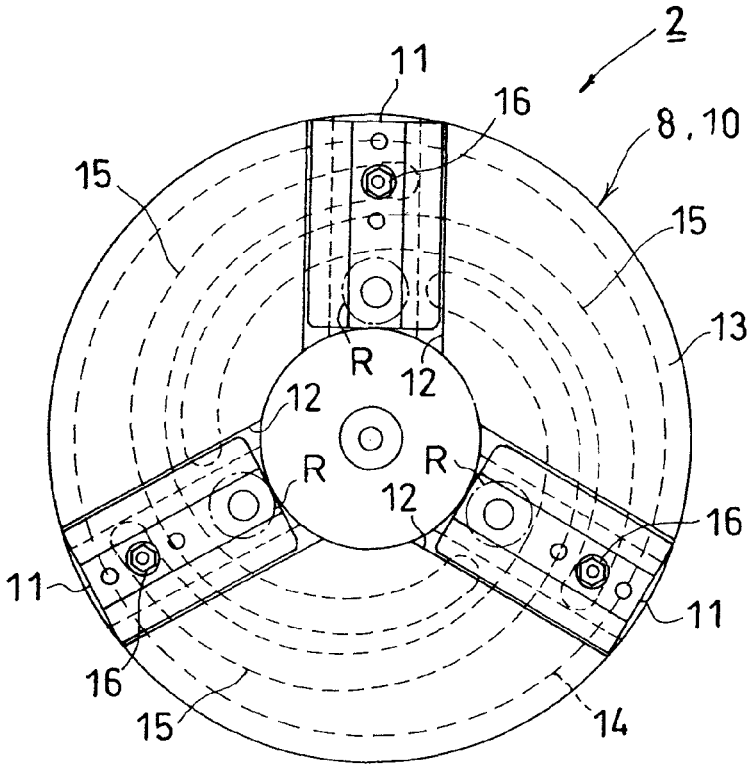
FIG. 4 is a side view of the spindle mechanism of the spinning apparatus above.

The work piece holding mechanism 3, intended for holding a work piece W in a non-circular cylindrical shape or, more preferably, a work piece W in elliptical shape including an ellipse and a flat part, comprises a lower fixed claw 20 and an upper lifting claw 21, a lifting frame 23 provided with a cylinder 22 for lifting claw 21, a supporting frame 24 for supporting lifting frame 23 so as to allow movement up and down, and a fixed base 25 for supporting supporting frame 24 in a way to allow moving in the transversal direction (left-right direction in FIG. 2).

Here, the lower fixed claw 20 and the upper lifting claw 21 of the work piece holding mechanism 3 are constructed, in this embodiment, in such a way that the minor axis plane of the work piece W in a non-circular cylindrical shape held by the lower fixed claw 20 and the upper lifting claw 21 agrees with a horizontal plane.

The shape, etc. of the lower fixed claw 20 and the upper lifting claw 21 of the work piece holding mechanism 3 is not restricted to that of this embodiment, but may be modified as required depending on the shape, etc. of the work piece W to be held.

As moving mechanism of the work piece holding mechanism 3, a lifting motor 26 for lifting the lifting frame 23 along a guide 27 and a traversing motor 28 for moving the supporting frame 24 in the transversal direction (left-right direction in FIG. 2) along a guide 29, thereby enabling the work piece W held by the work piece holding mechanism 3 to displace against the shaft center of the spindle 7.

The work piece holding mechanism 3 is provided, in addition to the above-described moving mechanism, with a slewing mechanism 9 of the supporting frame 24 as displacing mechanism for displacing the work piece W by a prescribed angle in the plane containing the minor axis plane of the work piece W in non-circular cylindrical shape (on a horizontal plane, in this embodiment).

Next, explanation will be given for the spinning method of a work piece in a non-circular cylindrical shape using this spinning apparatus 1 of work piece in non-circular cylindrical shape.

Figure 6:
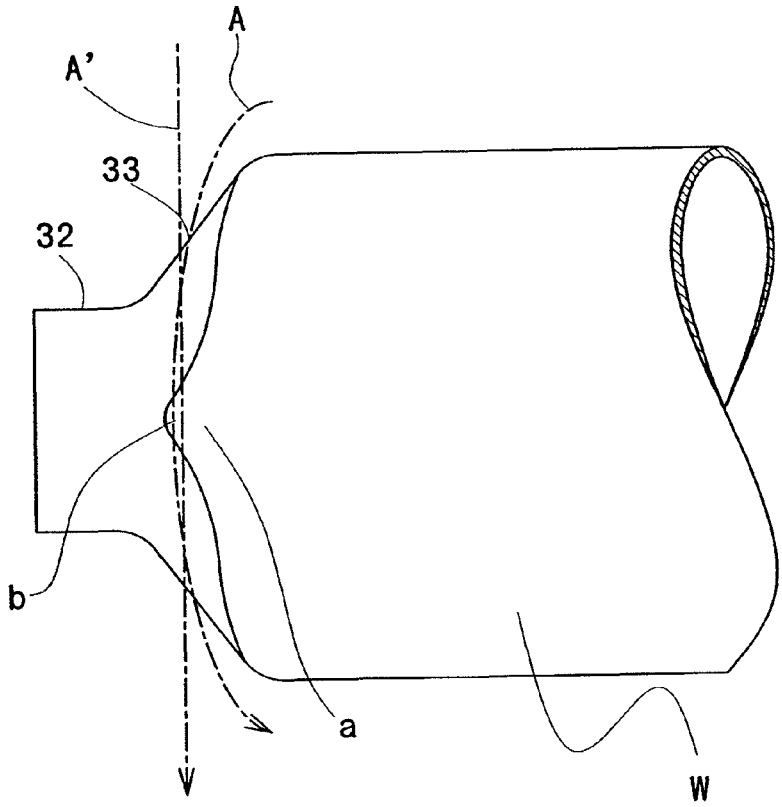
FIG. 6 is an explanatory drawing of the spinning method above, (a) being a front elevation of the work piece, and (b) left side view of the same.
Figure 6:
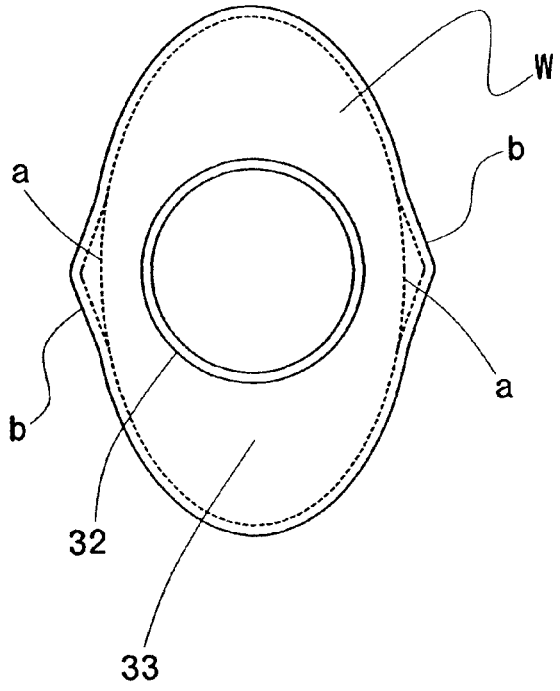
Figure 7:
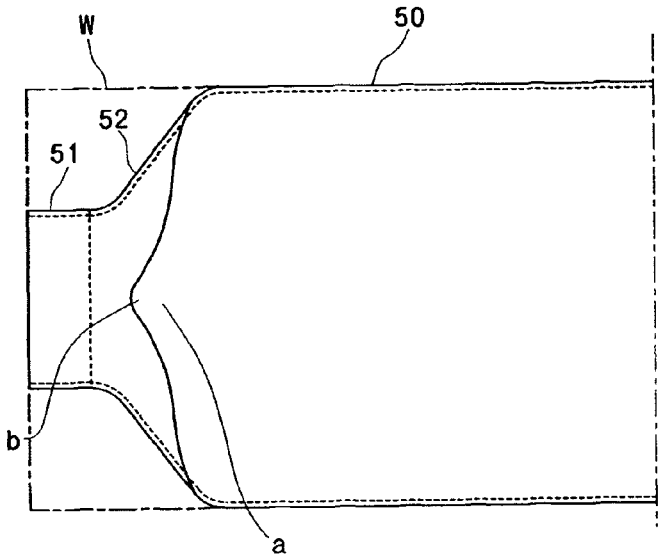
FIG. 7 PRIOR ART
FIG. 7 is a plan view of a product manufactured by performing spinning by a conventional working method on a work piece in non-circular cylindrical shape.
Figure 8:
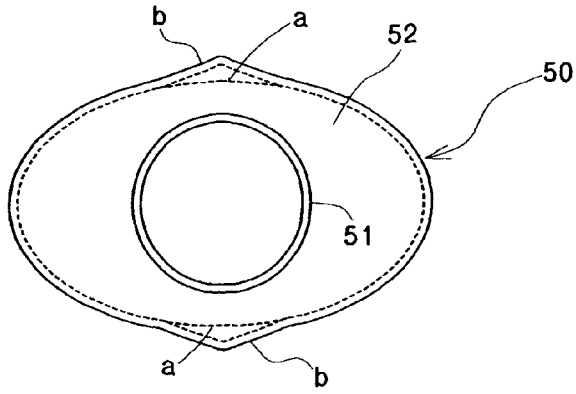
FIG. 8 PRIOR ART
FIG. 8 is a left side view of above.
Figure 9:
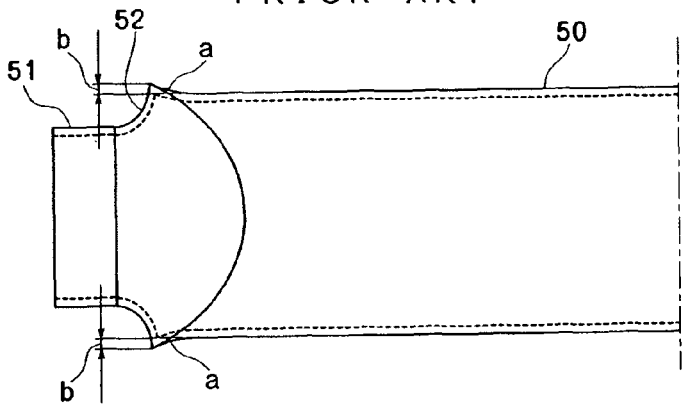
FIG. 9 PRIOR ART
FIG. 9 is a front elevation of above.
Figure 10:
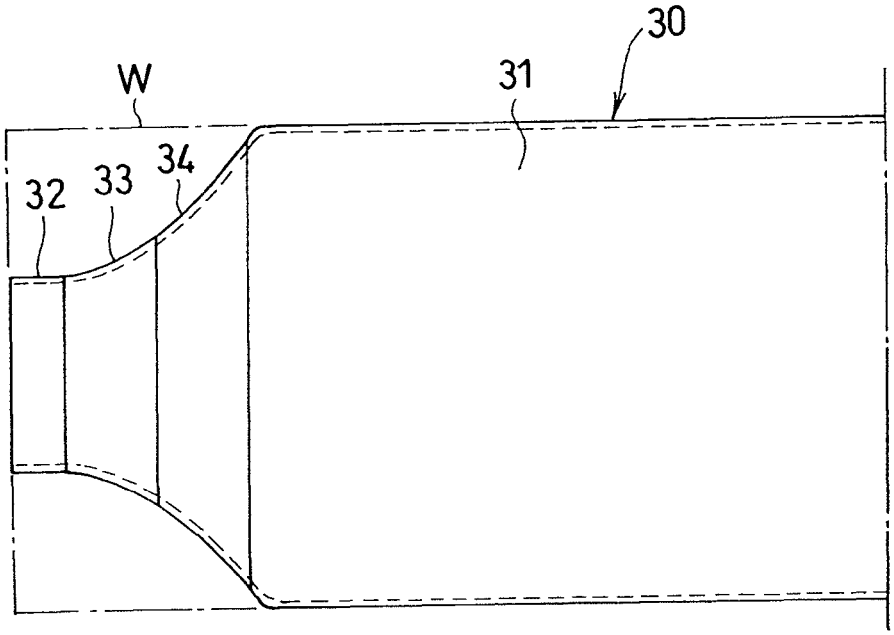
FIG. 10 PRIOR ART
FIG. 10 is a plan view of a product manufactured by performing spinning on a work piece in non-circular cylindrical shape by the method described in Japanese Laid-Open Patent Application No. 2001-257256.
Figure 11:
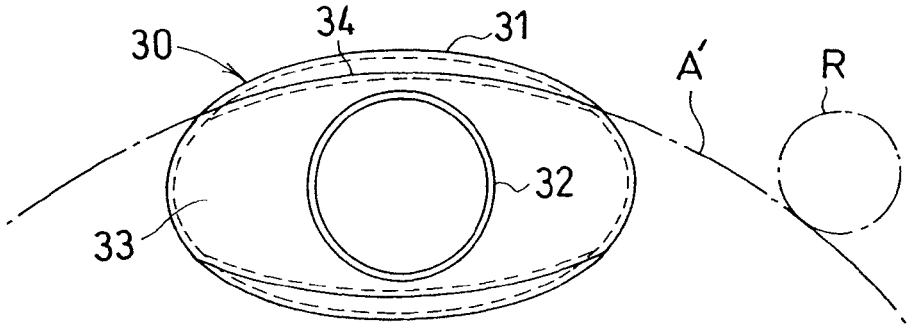
FIG. 11 PRIOR ART
FIG. 11 is a left side view of above.

As shown in FIG. 6, spinning is performed, by a working method similar to the conventional working method, to one end part of the work piece W in a non-circular cylindrical shape, or in an elliptical cylindrical shape for example, into an inclined face 33 inclined so as to gradually reduce the diameter, and form a certain length of the end part into a circular cylindrical shape 32 with a prescribed diameter, as required.

Figure 5:
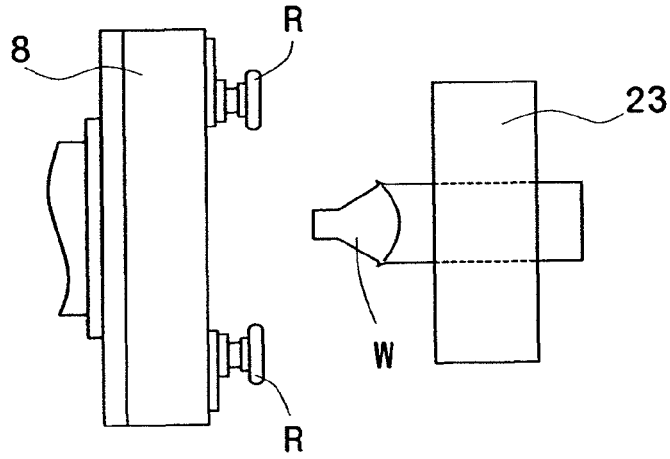
FIG. 5 is an explanatory drawing showing an embodiment of the spinning method of work piece in non-circular cylindrical shape according to the present invention, (a) showing the state in which an end part of a work piece in a non-circular cylindrical is inclined so as to gradually reduce in diameter, (b) showing the initial position for performing spinning to the swollen part of the work piece displaced by a prescribed angle in a horizontal plane, and (c) showing the state in which, after (b), spinning was performed on the swollen part by separating the spindle mechanism from the work piece holding mechanism.
Figure 5:
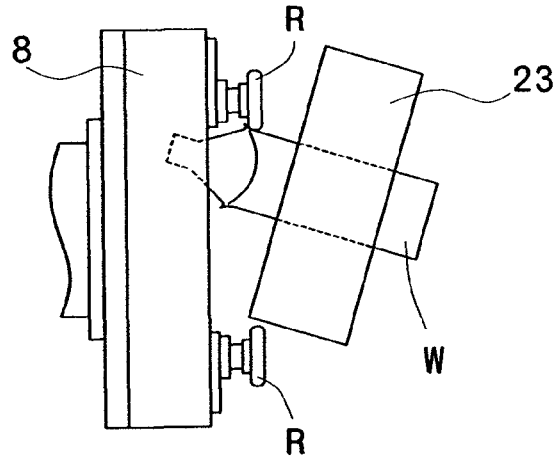
Figure 5:
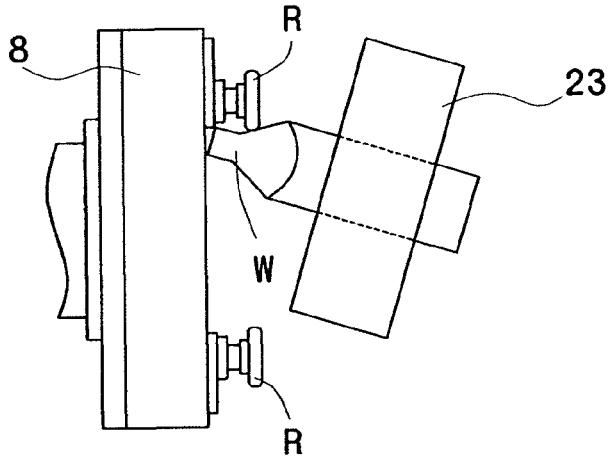

After that, from the state indicated in FIG. 5 (*a*), the work piece W is displaced by a prescribed angle in the plane containing the minor axis plane of the work piece in a non-circular cylindrical shape (on a horizontal plane, in this embodiment), by means of the slewing mechanism 9 of the supporting frame 24 and, in the state in which the tip side on one hand of the minor axis a of the work piece W, namely the portion where the roller R does not come into contact with the work piece W on the occasion of the spinning in the preceding process and that a swollen part b is produced in a region near the minor axis a of the work piece W as a result of gathering of pads of the work piece W in the surrounding area, may come to the outermost circumferential side against the shaft center of the spindle 7, as shown in FIG. 5 (*b*), spinning is performed to the swollen part b with the roller R.

This spinning does not temporarily produce any large load on the swollen part b, unlike the case of the conventional working method in which the spinning roller R come into contact right from the side face with the swollen part b which is positioned on the roller R side with reference to the working locus A' of the roller R, because the working locus A of the spinning roller R forms a smooth curve along the ridgeline of the swollen part b, as shown in FIG. 6 (*a*), thus enabling to spinning to be performed smoothly and eliminate the swollen part b, without causing any creases or depressions on the formed face.

Furthermore, in this case, it is possible to freely set the shape of the formed face, by moving the work piece W, displaced by a prescribed angle in the plane (horizontal plane, in this embodiment) containing the minor axis a plane of the work piece W in a non-circular cylindrical shape, in the plane concerned, while performing spinning to the swollen part b in a region near the minor axis a of the work piece W and, to be more specific, by moving the supporting frame 24 in the transversal direction (upward in FIG. 5), while separating the spindle mechanism 2 and the work piece holding mechanism 3 from each other as shown in FIG. 5 (*c*) from the state indicated in FIG. 5 (*b*), for example.

In this way, by performing spinning for eliminating the swollen part b on one side of the minor axis a of the work piece W in a non-circular cylindrical shape, and then performing spinning in the same way by displacing the work piece W by a prescribed angle in the opposite direction, it becomes possible to eliminate the swollen part b on the other side.

So far explanation has been given on the spinning method for performing spinning on a work piece in a non-circular and an apparatus for performing the method according to the present invention, based on an embodiment. However, the present invention is not restricted to the construction described in the above-mentioned embodiment but may be modified in construction as required within a range not deviating from the main purpose of the invention.

The spinning method of a work piece in a non-circular cylindrical shape and apparatus for performing the method according to the present invention are capable of eliminating a swollen part, without causing any creases or depressions on the formed face, by performing spinning to the swollen part produced in a region near the minor axis of the work piece in a non-circular cylindrical shape and, for that reason, they can be used suitably in the case where the end part of a work piece in a non-circular cylindrical shape is formed into an inclined face inclined so as to gradually reduce in diameter.

The invention claimed is:

1. A spinning method of a work piece in a non-circular cylindrical shape comprising a spindle mechanism provided with a spinning roller at a tip of a spindle and a work piece holding mechanism for holding the work piece in the non-circular cylindrical shape so as to be disposed face to face with the spindle mechanism, for spinning the end part of the work piece into a circular cylindrical shape, said method comprising:

performing spinning to form the end part of the work piece into an inclined face inclined so as to gradually become smaller in diameter-gradually, and subsequently performing spinning on a swollen part produced in a region adjacent a minor axis of the work piece by displacing the work piece by a prescribed angle in a plane containing the minor axis plane of the work piece in the non-circular cylindrical shape.

2. A spinning method for a work piece in a non-circular cylindrical shape as defined in claim 1, wherein the work piece, displaced by a prescribed angle in the plane containing the minor axis plane of the work piece in the non-circular cylindrical shape is moved in the plane, while performing spinning to the swollen part produced in the region adjacent the minor axis of the work piece.

3. A spinning method for a work piece in a non-circular cylindrical shape as defined in claim 1, wherein said subsequently performing spinning on the swollen part eliminates the swollen part on a first side of the minor axis, and said method further includes displacing the work piece by another prescribed angle that is opposite to the prescribed angle, and eliminating another swollen part on a second side of the minor axis.

* * * * *